US009153873B2

(12) United States Patent
Ng et al.

(10) Patent No.: US 9,153,873 B2
(45) Date of Patent: Oct. 6, 2015

(54) MULTIPLE-ANTENNA SYSTEMS WITH ENHANCED ISOLATION AND DIRECTIVITY

(71) Applicant: Laird Technologies, Inc., Earth City, MO (US)

(72) Inventors: Kok Jiunn Ng, Penang (MY); Tze Yuen Ng, Kedah (MY)

(73) Assignee: Laird Technologies, Inc., Earth City, MO (US)

( * ) Notice: Subject to any disclaimer, the term of this patent is extended or adjusted under 35 U.S.C. 154(b) by 360 days.

(21) Appl. No.: 13/692,431

(22) Filed: Dec. 3, 2012

(65) Prior Publication Data

US 2013/0093641 A1 Apr. 18, 2013

Related U.S. Application Data

(63) Continuation of application No. PCT/MY2010/000125, filed on Jul. 19, 2010.

(51) Int. Cl.

| | |
|---|---|
| ***H01Q 19/10*** | (2006.01) |
| ***H01Q 21/28*** | (2006.01) |
| ***H01Q 1/52*** | (2006.01) |
| ***H01Q 9/42*** | (2006.01) |
| ***H01Q 21/20*** | (2006.01) |

(52) U.S. Cl.

CPC ..... *H01Q 21/28* (2013.01); *H01Q 1/521* (2013.01); *H01Q 9/42* (2013.01); *H01Q 21/205* (2013.01)

(58) Field of Classification Search

CPC ..... H01Q 9/42; H01Q 21/205; H01Q 21/28; H01Q 1/521

See application file for complete search history.

(56) References Cited

U.S. PATENT DOCUMENTS

| | | | | |
|---|---|---|---|---|
| 3,790,943 | A * | 2/1974 | Pickles et al. | 342/399 |
| 4,611,214 | A * | 9/1986 | Campbell et al. | 343/790 |
| 5,654,724 | A | 8/1997 | Chu | |
| 6,140,972 | A | 10/2000 | Johnston et al. | |
| 7,834,809 | B2 * | 11/2010 | Tseng et al. | 343/700 MS |
| 2003/0090423 | A1 * | 5/2003 | Horii | 343/727 |
| 2003/0095096 | A1 * | 5/2003 | Robbin et al. | 345/156 |
| 2005/0237258 | A1 * | 10/2005 | Abramov et al. | 343/834 |
| 2006/0109193 | A1 * | 5/2006 | Williams | 343/797 |
| 2010/0013729 | A1 * | 1/2010 | Harel et al. | 343/837 |

(Continued)

FOREIGN PATENT DOCUMENTS

| | | |
|---|---|---|
| CN | 201430211 Y | 3/2010 |
| EP | 2083472 | 7/2009 |

(Continued)

OTHER PUBLICATIONS

International Search Report for PCT/MY2010/000125 (published as WO 2012/011796) dated May 2, 2011, 3 pages. The instant application is a continuation of PCT/MY2010/000125.

(Continued)

*Primary Examiner* — Trinh Dinh

(74) *Attorney, Agent, or Firm* — Harness, Dickey & Pierce, P.L.C.

(57) ABSTRACT

Exemplary embodiments are provided of multiple-antenna systems with enhanced and/or good isolation and directivity. In one exemplary embodiment, a system generally includes a ground plane and two or more antenna elements coupled to the ground plane. The system also includes two or more low frequency isolators/reflectors and two or more high frequency isolators/reflectors coupled to the ground plane.

14 Claims, 8 Drawing Sheets

(56) References Cited

U.S. PATENT DOCUMENTS

| | | | | |
|---|---|---|---|---|
| 2010/0141530 | A1* | 6/2010 | McMahon | 342/417 |
| 2013/0093641 | A1* | 4/2013 | Ng et al. | 343/841 |

FOREIGN PATENT DOCUMENTS

| | | |
|---|---|---|
| JP | 2006-148917 | 6/2006 |
| KR | 10-2007-0016537 | 2/2007 |
| WO | WO 2005-114789 | 12/2005 |
| WO | WO 2010/068537 | 6/2010 |
| WO | WO 2012/011796 | 1/2012 |

OTHER PUBLICATIONS

Chinese office action dated Mar. 19, 2014 issued for Chinese application No. 201080068131.3 (published as CN103004018) which claims priority to the same parent application as the instant application; 9 pages.

* cited by examiner

MULTIPLE-ANTENNA SYSTEMS WITH ENHANCED ISOLATION AND DIRECTIVITY

CROSS-REFERENCE TO RELATED APPLICATION

This application is a continuation of PCT International Application No. PCT/MY2010/000125 filed on Jul. 19, 2010 (now published as WO 2012/011796, published on Jan. 26, 2012). The entire disclosure of the above application is incorporated herein by reference.

FIELD

The present disclosure generally relates to multiple-antenna systems with enhanced and/or good isolation and directivity.

BACKGROUND

This section provides background information related to the present disclosure which is not necessarily prior art.

Multiple-antenna radio systems generally use multiple antennas at the transmitter and/or receiver to improve communication performance. Such multiple-antenna systems are commonly referred to or known as Multiple Input Multiple Output (MIMO) antenna systems. Multiple-antenna radio systems are commonly used in wireless communications, because these systems may offer significant increases in data throughput and link range without additional bandwidth or transmit power.

SUMMARY

This section provides a general summary of the disclosure, and is not a comprehensive disclosure of its full scope or all of its features.

According to various aspects, exemplary embodiments are disclosed of multiple-antenna systems having enhanced and/or good isolation and directivity. In an exemplary embodiment, an antenna system generally includes a ground plane and two or more antenna elements coupled to the ground plane. The system also includes two or more low frequency isolators/reflectors and two or more high frequency isolators/reflectors coupled to the ground plane.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 4:
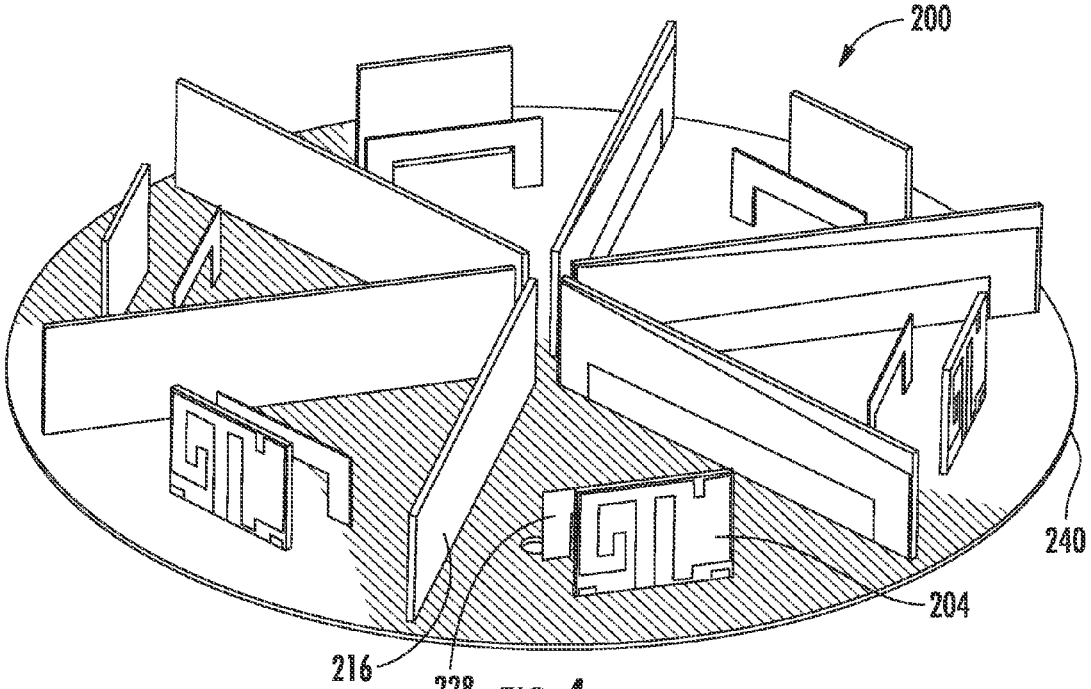
Figure 5:
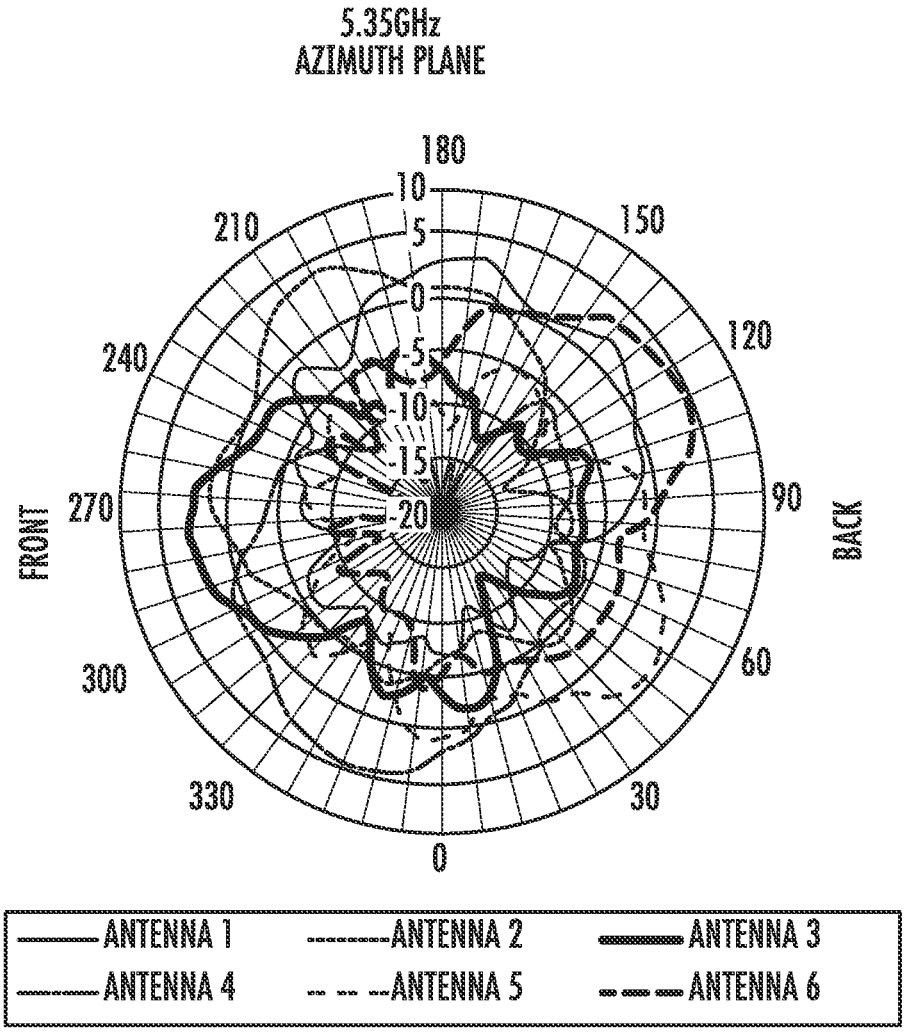

FIG. 4 is a perspective view of another exemplary embodiment of a multiple-antenna system having six antenna elements, six high frequency isolators/reflectors, and six low frequency isolators/reflectors, where the internal antenna components (typically covered and hidden from view by a radome) are shown for clarity; and FIG. 5 illustrates exemplary azimuth plane radiation patterns measured for the six antenna elements of a prototype of the multiple-antenna system shown in FIG. 4 at a frequency of 5.35 gigahertz.

DETAILED DESCRIPTION

Example embodiments will now be described more fully with reference to the accompanying drawings.

In multiple-antenna systems, multiple antennas are used to improve transmission robustness and/or increase transmission rate. Generally, multiple antennas for multiple input multiple output (MIMO) systems perform well under the condition that the antennas have low cross correlation in different schemes namely spatial scheme, pattern scheme, and polarization scheme. For economical reasons during design and manufacturing, the multiple antennas are usually of identical design. With the market trend towards smaller and more compact devices, the decreasing overall size of the device means that the antennas are being increasingly put closer and closer together. But having multiple antennas in close proximity results in poor isolation between the antennas, which, in turn, decreases the performance of the radio system. For example, the inventors have recognized that because the antennas are usually of identical design for a multiple-antenna system, the radiation patterns might overlap with equal antenna gain. In which case, stability might become an issue when the radio system constantly switches back and forth between the antennas.

Accordingly, the inventors have disclosed herein multiple-antenna systems including multiple antennas and multiple isolators/reflectors to enhance the isolation between antennas and at the same time increase the directivity of the individual antenna elements. In various exemplary embodiments, each antenna element has a sector-shaped radiation pattern with an equally-divided coverage sector angle such that the sum of all sector angles for the antenna elements equals the total coverage angle required. This is considered to be utilizing the pattern scheme that offers higher capacity and longer range for the systems.

In various exemplary embodiments, a system includes a one-to-one ratio of antenna elements to the high frequency isolators/reflectors and to the low frequency isolators/reflectors. That is, these exemplary embodiments include the same number of antenna elements, high frequency isolators/reflectors, and low frequency isolators/reflectors. For example, the inventors have disclosed exemplary embodiments (e.g., system 100 (FIG. 3), etc.) that includes three antenna elements, three high frequency isolators/reflectors, and three low frequency isolators/reflectors. The inventors have also disclosed exemplary embodiments (e.g., system 200 (FIG. 4), etc.) that includes six antenna elements, six high frequency isolators/reflectors, and six low frequency isolators/reflectors. Other exemplary embodiments may include more or less antenna elements, high frequency isolators/reflectors, and/or low frequency isolators/reflectors, as a system may be scaled (e.g., two antennas, four antennas, five antennas, seven antennas, etc.) accordingly depending on the particular requirements of the intended application or end-use. In addition, other exemplary embodiments need not include a one-to-one ratio or equal/same number of antenna elements, high frequency isolators/reflectors, and/or low frequency isolators/reflectors. For example, other exemplary embodiments may include a number of high frequency isolators/reflectors and/or low frequency isolators/reflectors equal to, greater than, or less than the number of antenna elements.

In various exemplary embodiments, a system includes multiple antenna elements and multiple isolators/reflectors. The isolators/reflectors may be positioned relative to the antenna elements to increase isolation between the antenna elements and/or increase directivity of each antenna element in the direction of the sector that the particular antenna element serves. The multiple isolators/reflectors may include one or more combined high frequency and low frequency isolators/reflectors. Additionally, or alternatively, the multiple isolators/reflectors may include one or more high frequency isolators/reflectors that are separate and/or spaced apart from one or more low frequency isolators/reflectors. By way of example only, a low frequency isolators/reflector may be configured to be operable with frequencies falling within the 2.45 gigahertz band (from 2.4 gigahertz to 2.5 gigahertz), and a high frequency isolators/reflector may be configured to be operable with frequencies falling within the 5 gigahertz band (from 4.9 gigahertz to 5.875 gigahertz). These frequencies are only examples, however, as aspects of the present disclosure are not limited solely to these two frequency bands.

In one particular exemplary embodiment, an antenna system includes three antenna elements configured for operation in a high frequency band and low frequency band. Isolators/reflectors are mounted vertically over a ground plane. The antenna elements are placed equidistant from the center of a circular portion of the ground plane, which circular portion may simply be an imaginary or reference circle that is imagined or defined on the top surface of the ground plane for reference purposes. The mounting point of the antenna elements are on the circumference of the circular portion or imaginary circle on the ground plane. The antenna elements are spaced equally apart, so that a one hundred twenty degree (120°) arc is formed or defined between the mounting point of two adjacent antenna elements and the center of the imaginary circle or circular portion on the ground plane. Three inverted U shaped low frequency isolators/reflectors are placed in a star-shaped configuration centered at the center of the imaginary circle or circular portion on the ground plane. Another three inverted U shaped high frequency isolators/reflectors are each placed adjacent a corresponding one of the antenna element between that antenna element and the center of the imaginary circle or circular portion on the ground plane. The antenna elements may be of any type suitable, such as a monopole antenna, an inverted F antenna (IFA), planar inverted F antenna (PIFA), etc. The inverted U shaped elements are operable as both isolators and reflectors. The frequency at which each upside down or inverted U shaped element is effective is determined primarily by the length of the horizontal section of the upside down or inverted U shaped element. With this exemplary disclosed embodiment, the isolation between the antenna elements was increased (e.g., by about seven percent to about ten percent, etc.). This increased isolation allows for more antenna elements to be put in the same volume of space and/or allows the same number of antennas to be put in a smaller volume of space. This example embodiment also allows for increased directivity of each antenna element in the direction of the sector that the particular antenna element serves. In turn, this will help improve radio stability and increase receive-sensitivity extending the range of the radio transmission.

Figure 1:
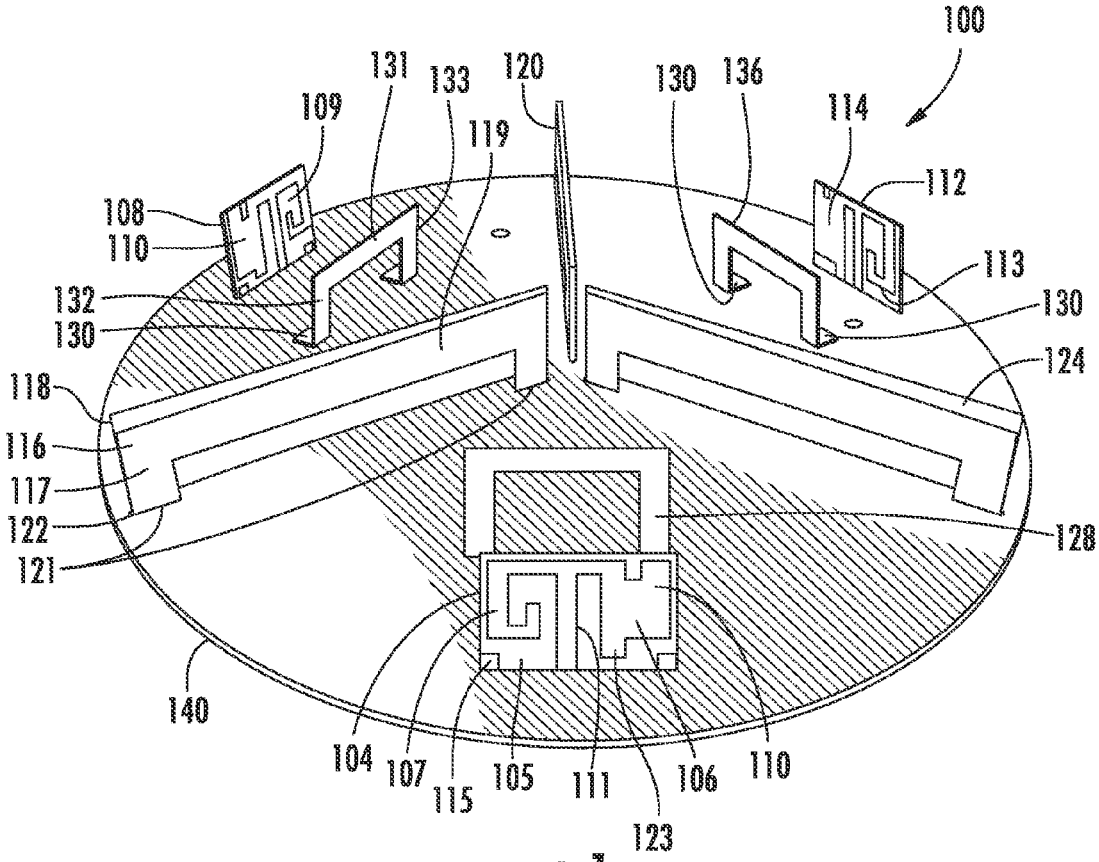
FIG. 1 is a perspective view of a multiple-antenna system having three antenna elements, three high frequency isolators/reflectors, and three low frequency isolators/reflectors according to an exemplary embodiment of the present disclosure, where the internal antenna components (typically covered and hidden from view by a radome) are shown for clarity.

With reference now to the figures, FIG. 1 illustrates an exemplary embodiment of a multiple-antenna system 100 embodying one or more aspects of the present disclosure. As shown, the antenna system 100 includes three antenna elements 104, 108, 112, three low frequency isolators/reflectors 116, 120, 124, and three high frequency isolators/reflectors 128, 132, 136. The antenna elements and isolators/reflectors are mounted on or to the ground plane 140 in a generally vertical orientation and perpendicularly relative to the ground plane 140.

This particular system 100 is configured for use as tri-sectorial multiple-antenna system (e.g., MIMO antenna system), although aspects of the present disclosure are not limited solely to tri-sectorial and/or MIMO antenna systems. And, each antenna element 104, 108, 112 may be identical to the other antenna elements, or one or more of the antenna elements may be differently configured (e.g., shaped, sized, different materials, etc.) than the other antenna elements depending on the particular end use or application. In addition, each of the low frequency isolators/reflectors 116, 120, 124 may be identical, or they may be different from each other. Likewise, each of the high frequency isolators/reflectors 128, 132, 136 may be identical, or they may be different from each other.

With continued reference to FIG. 1, each antenna element 104, 108, 112 includes, and/or is supported by, a substrate, such as substrate 105, 109, 113. The substrates 105, 109, and/or 113 may be a rigid insulator, such as a circuit board substrate (e.g., Flame Retardant 4 or FR4, etc.), plastic carrier, etc. Alternatively, the substrates 105, 109, and/or 113 may be a flexible insulator, such as a flexible circuit board, flex-film, etc. The antenna elements 104, 108, 112 may include electrically-conductive material (e.g., copper, gold, silver, alloys, combinations thereof, other electrically-conductive materials, etc.) in the form of traces 106, 110, 114 on the substrates 105, 109, 113, respectively. The antenna elements 104, 108, 112 may be single or multiple layered PCB antennas. Alternatively, the antenna elements 104, 108, 112 (whether mounted on a substrate or not) may be constructed from sheet metal by cutting, stamping, etching, etc.

Each antenna element 104, 108, 112 includes a first radiating or resonant element for a low frequency band (e.g., from 2.4 gigahertz to 2.5 gigahertz, etc.) and a second radiating or resonant element for a high frequency band (e.g., from 4.9 gigahertz to 5.875 gigahertz, etc.). The first and second radiating elements of each antenna element 104, 108, 112 may be quarter wavelength (¼ λ) radiating elements, such that each of the first and second radiating elements is sized to be approximately one quarter of the wavelength of a desired resonant frequency. In this particular example, the antenna element 104 includes a first low frequency arm 107 and a second high frequency arm 110. In this exemplary embodiment, the high frequency arms are shorter than the low frequency arms. The arms or elements are folded (e.g., spiral shaped, etc.), bent, and/or turned to help reduce the overall size. Antennas according to the present disclosure are not limited, however, to the particular shape, size, configuration, etc. of the antenna elements shown in FIG. 1. In addition, the frequencies set forth in this paragraph are only examples, as aspects of the present disclosure are not limited solely to these two frequency bands.

Figure 1A:
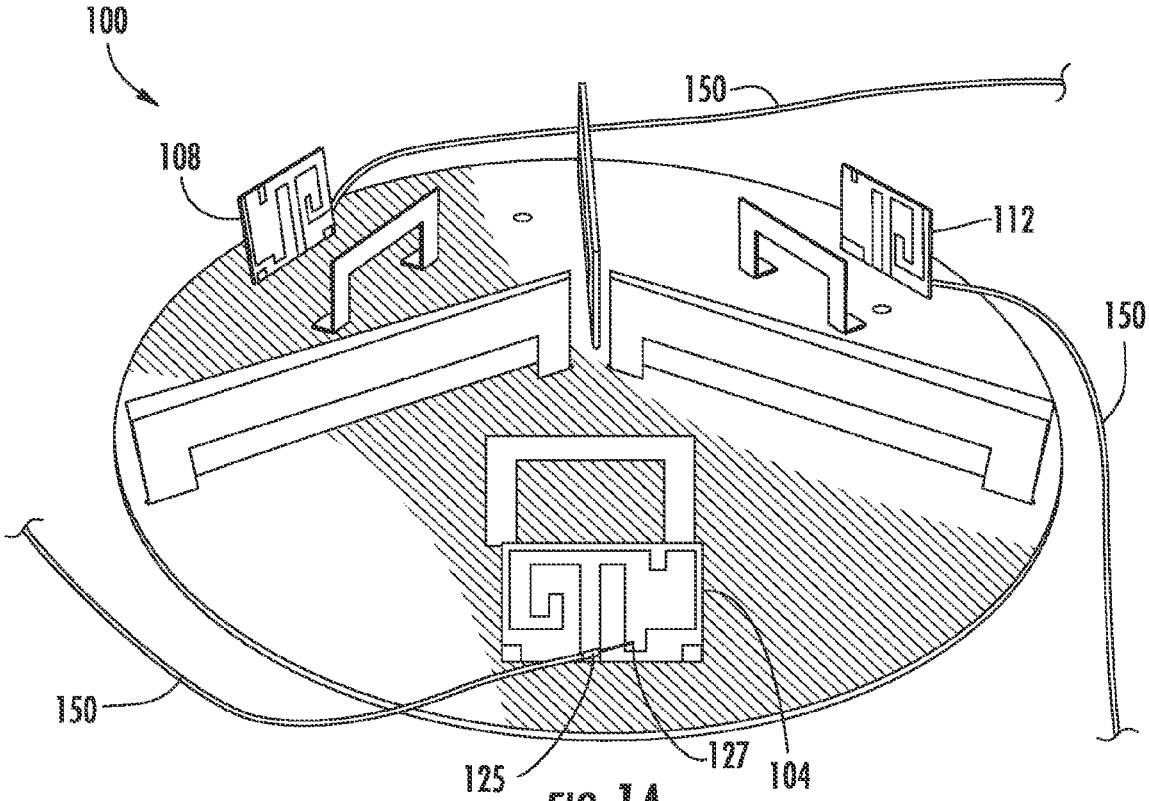
FIG. 1A is a perspective view of the multiple-antenna system shown in FIG. 1 and exemplary coaxial cables feeding the antenna elements according to an exemplary embodiment.

The antenna elements 104, 108, and 112 also include feeding elements and ground points. As shown in FIG. 1, the antenna element 104 includes a feeding element 123 and grounding point 111. In this example, the bottom of the feeding element 123 may provide a feeding point, for example, for connection to (e.g., soldering, etc.) a coaxial cable, other feed, or transmission line. For example, FIG. 1A illustrates an exemplary embodiment in which coaxial cables 150 are shown feeding the antenna elements 104, 108, 112 of the antenna 100. In this example illustrated in FIG. 1A, the coaxial cable 150 includes a braid 125 that is soldered to the grounding point 111 of the antenna element 104. The coaxial cable 150 also includes a signal center conductor 127 that is soldered to the feeding point 123 of the antenna element 104. Alternative embodiments may include other feeding arrangements besides coaxial cable.

Soldering pads 115 allow the antenna element 104 to be soldered to the ground plane 140 (e.g., ground plane of PCB, metal sheet, etc.). In some embodiments, the bottom of the antenna elements 104, 108, 112 may include downwardly extending tabs that are insertable or positionable within slots or holes in the ground plane 140 for aligning and mechanically mounting the antenna elements 104, 108, 112 to the ground plane 140. Alternative embodiments may include other means for aligning and/or mechanically mounting an antenna element to a ground plane.

In this example, the antenna elements 104, 108, 112 are mounted to the ground plane 140 equidistant from the center of a circular portion on the ground plane 140, which circular portion may simply be an imaginary or reference circle that is on top of the ground plane 140 for reference purposes when mounting the antenna components. In this illustrated example, the center of the circular portion or imaginary circle coincides with or is the same as the center of the ground plane 140 in FIG. 1, etc. The mounting points or location of the antenna elements 104, 108, 112 are placed along the perimeter or circumference of the imaginary circle or circular portion on the ground plane 140. The antenna elements 104, 108, 112 are spaced equally apart, so that a one hundred twenty degree (120°) arc is formed or defined between the mounting point of two adjacent antenna elements and the center of the imaginary circle or circular portion on the ground plane 140. Alternative embodiments may include other mounting arrangements for the antenna elements on the ground plane.

The dimensions, shapes, and mounting location (e.g., location of grounding points, etc.) of the low frequency isolators/reflectors 116, 120, 124 relative to the antenna elements 104, 108, 112 may be determined (e.g., optimized, etc.) to improve the isolation between the antenna elements 104, 108, 112. In this particular example shown in FIG. 1, the low frequency isolators/reflectors 116, 120, 124 are mounted generally vertically or perpendicularly relative to the ground plane 140. And, the low frequency isolators/reflectors 116, 120, 124 comprise inverted U-shaped metallic strips 117 on a substrate 118, which are arranged or placed in a star-shaped or spoked configuration centered at the center of the imaginary circle or circular portion on the ground plane 140. In this example, the substrates 118 are positioned about the center of the ground plane 140 so as to extend outwardly in a direction away from the center of the ground plane 140.

A wide range of materials may be used for any of the substrates disclosed herein. By way of example, the low frequency isolators/reflectors 116, 120, 124 may include, and/or be supported by, substrates 118 comprising a rigid insulator, such as a circuit board substrate (e.g., Flame Retardant 4 or FR4, etc.), plastic carrier, etc. Alternatively, the substrates 118 may be a flexible insulator, such as a flexible circuit board, flex-film, etc. The inverted U shaped strips 117 on the substrates 118 may include electrically-conductive material (e.g., copper, etc.) in the form of traces on the substrates 118. The low frequency isolators/reflectors 116, 120, 124 (whether mounted on a substrate or not) may be constructed from sheet metal by cutting, stamping, etching, etc.

In this particular example, the low frequency isolators/reflectors 116, 120, 124 include the inverted U shaped strips 117 that are operable as both isolators and reflectors. The frequency at which each upside down or inverted U shaped strip 117 is effective is determined primarily by the length of the horizontal section 119 of the upside down or inverted U shaped element 117. The horizontal section 119 is generally parallel to the top surface of the ground plane 140 in this illustrated embodiment. The inverted U shaped element 117 also includes two vertical legs or grounding stubs 121 for electrically connecting to the ground plane 140. Alternative embodiments may include one or more isolators/reflectors with a different configuration (e.g., different shape, size, mounting location, etc.), such as L-shaped isolator/reflector.

In addition, the low frequency isolators/reflectors 116, 120, 124 may also include tabs along the bottom thereof. The tabs may be configured to be inserted or positioned within slots or holes 122 in the ground plane 140 for aligning and mechanically mounting the low frequency isolators/reflectors 116, 120, 124. Alternative embodiments may include other means for aligning and/or mechanically mounting an isolator/reflector to a ground plane.

The dimensions, shapes, and mounting location (e.g., location of grounding points, etc.) of the high frequency isolators/reflectors 128, 132, 136 relative to the antenna elements 104, 108, 112 may be determined (e.g., optimized, etc.) to improve the isolation between the antenna elements 104, 108, 112. In this particular example, the high frequency isolators/reflectors 128, 132, 136 are mounted generally vertically or perpendicularly relative to the ground plane 140. Each high frequency isolators/reflectors 128, 132, 136 is between the center of the ground plane 140 and a corresponding one of the antenna elements 104, 108 112. And, the high frequency isolators/reflectors 128, 132, 136 comprise inverted U-shaped metallic strips having end portions 130 electrically connected and mounted (e.g., soldered, etc.) to the ground plane 140. The illustrated high frequency isolators/reflectors 128, 132, 136 do not include any substrates supporting the inverted U-shaped metallic strips. Instead, the inverted U-shaped metallic strips have end portions 130 that are mounted to the ground plane 140 such that the horizontal and vertical portions 131, 133 are free-standing. Alternative embodiments may include a different configuration (e.g., different shape, size, mounting location, etc.) for one or more of the high frequency isolators/reflectors. For example, another exemplary embodiment may include one or more high frequency isolators/reflectors that include a substrate, such as a rigid insulator (e.g., plastic carrier, a circuit board substrate like Flame Retardant 4 or FR4, etc.) or a flexible circuit board, flex-film, etc.

In this particular example, the high frequency isolators/reflectors 128, 132, 136 include the inverted U shaped strips that are operable as both isolators and reflectors. The frequency at which each upside down or inverted U shaped strip is effective is determined primarily by the length of the horizontal section 131 of the upside down or inverted U shaped element. The horizontal section 131 is generally parallel to the top surface of the ground plane 140 in this illustrated embodiment.

In addition, the low frequency isolators/reflectors 116, 120, 124 may also include tabs along the bottom thereof. The tabs may be configured to be inserted or positioned within slots or holes 122 in the ground plane 140 for aligning and mechanically mounting the low frequency isolators/reflectors 116, 120, 124.

The ground plane 140 is shown as a circular metal plate. Alternative embodiment may include a ground plane having a different configuration, such as a ground plane with a different shape (e.g., non-circular etc.), different size (e.g., larger or smaller relative to the other components of the antenna 100), different materials, etc.

Figure 2A:
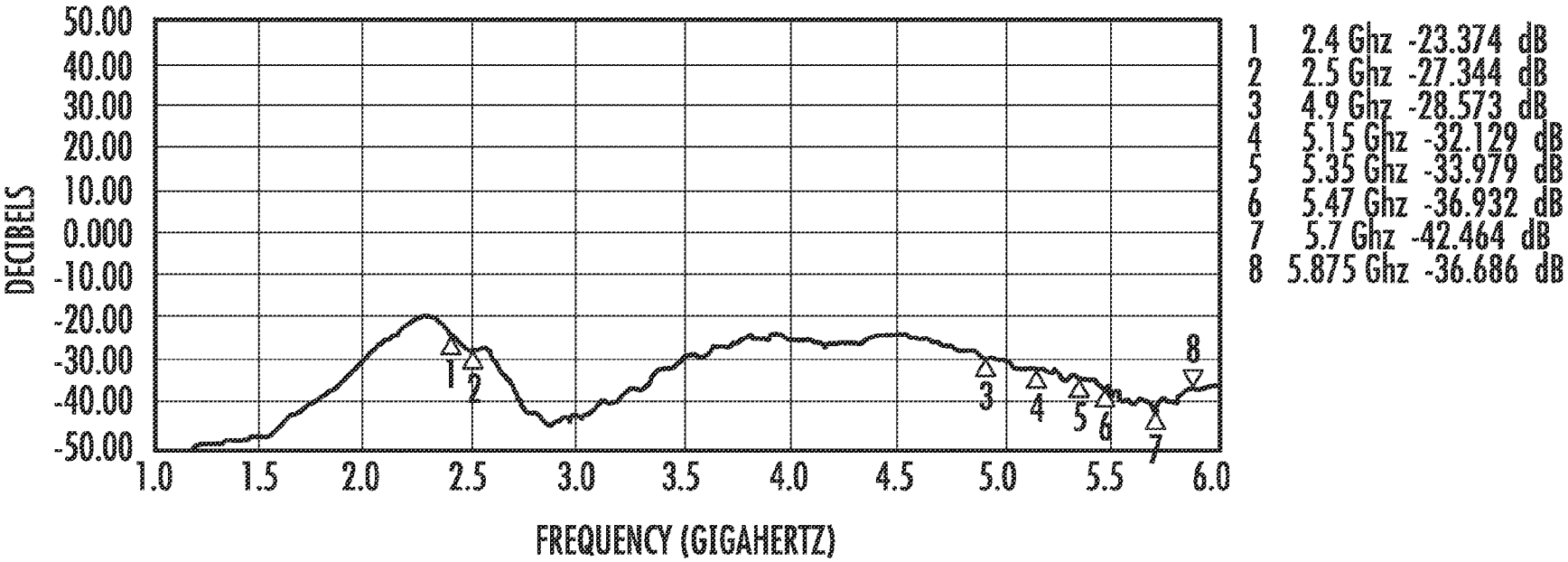
FIGS. 2A and 2B are exemplary line graphs illustrating isolation in decibels versus frequency (in gigahertz) measured for a prototype of the multiple-antenna system shown in FIG. 1 with isolators/reflectors (FIG. 2A) and without isolators/reflectors (FIG. 2B), respectively.
Figure 2B:
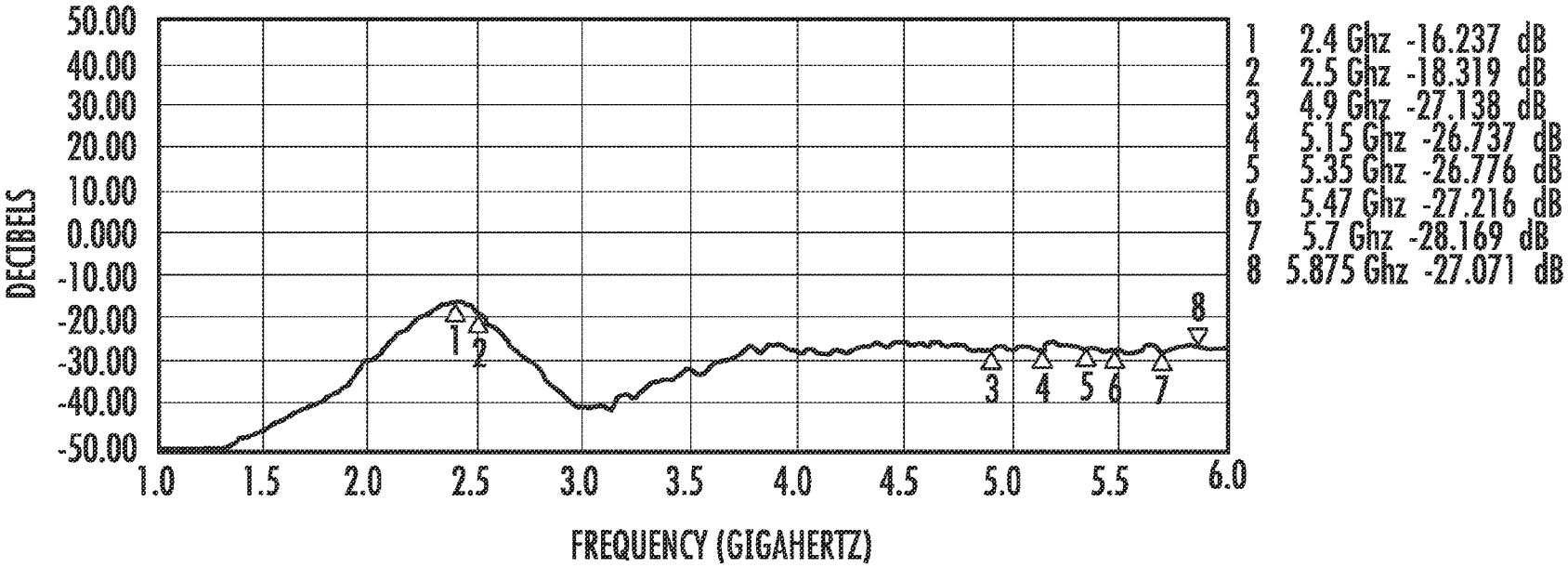
Figure 3A:
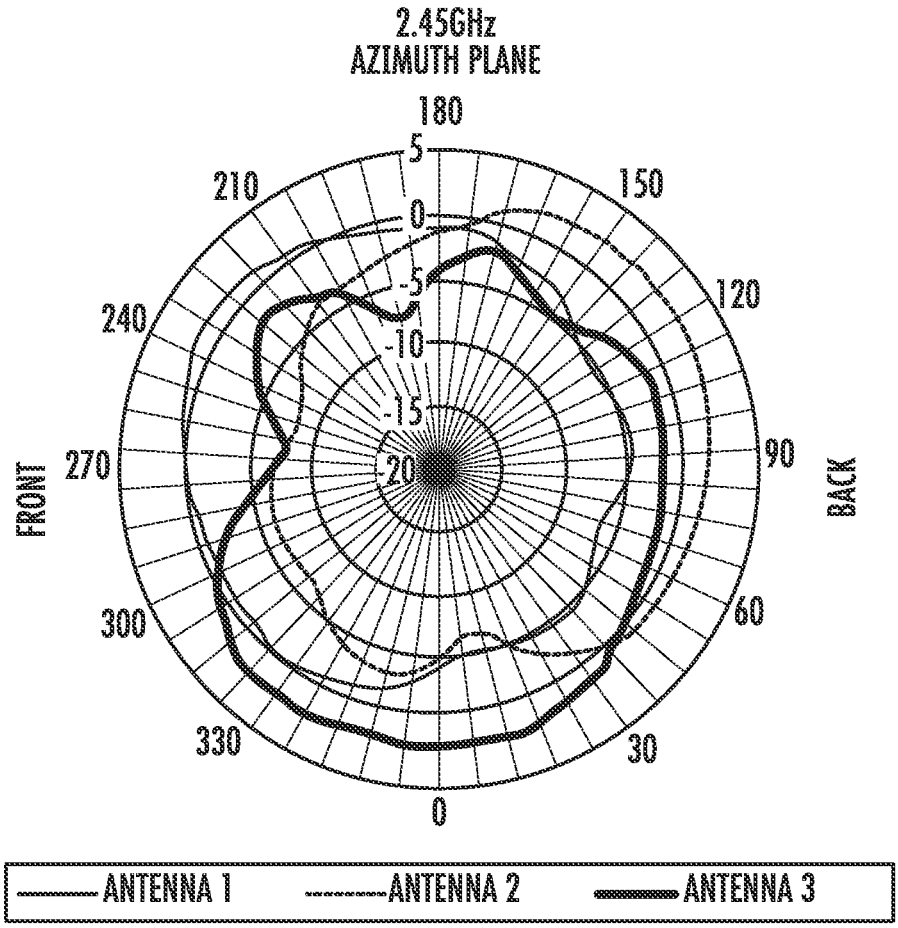
FIGS. 3A and 3B illustrate exemplary azimuth plane radiation patterns measured for the three antenna elements of a prototype of the multiple-antenna system shown in FIG. 1 at a frequency of 2.45 gigahertz (FIG. 3A) and 5.47 gigahertz (FIG. 3B)
Figure 3B:
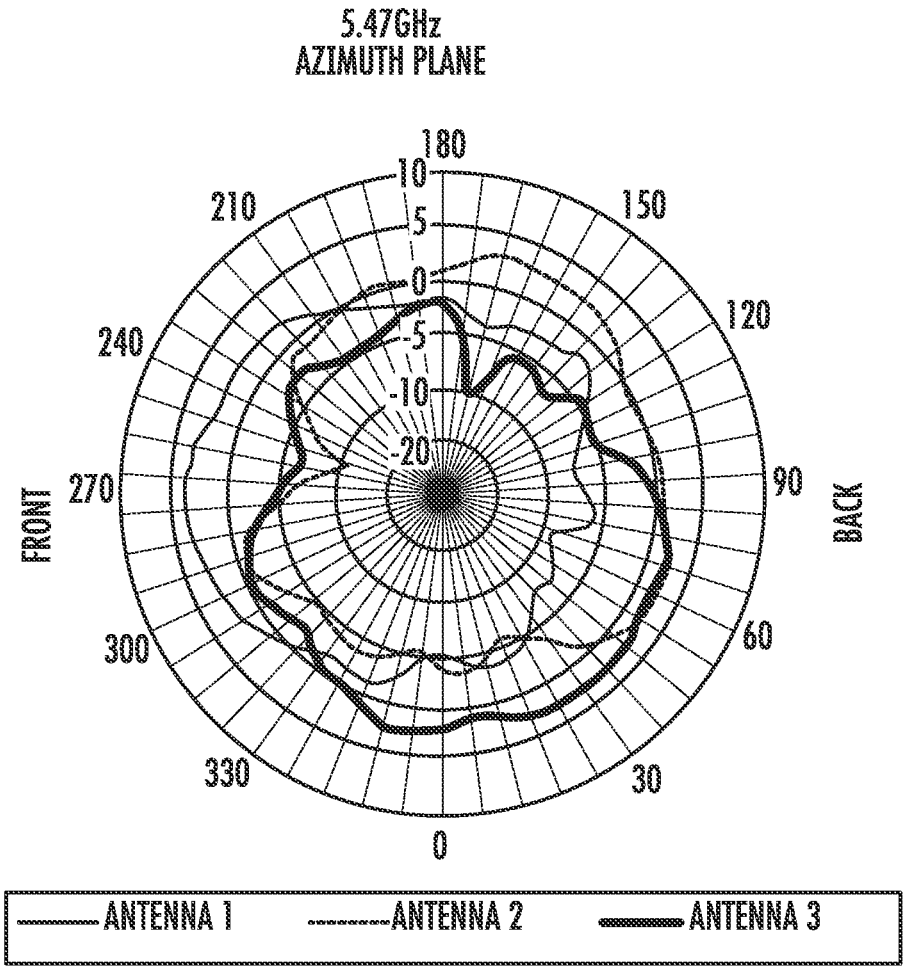

FIGS. 2A, 2B, 3A, and 3B illustrate analysis results measured for a prototype of the multiple-antenna system 100 shown in FIG. 1. These analysis results shown in FIGS. 2A, 2B, 3A, and 3B are provided only for purposes of illustration and not for purposes of limitation. More specifically, FIGS. 2A and 2B are exemplary line graphs illustrating isolation in decibels versus frequency (in gigahertz) measured for a prototype of the multiple-antenna system shown in FIG. 1 with isolators/reflectors (FIG. 2A) and without isolators/reflectors (FIG. 2B), respectively. FIGS. 3A and 3B illustrate exemplary azimuth plane radiation patterns measured for the three antenna elements of a prototype of the multiple-antenna system shown in FIG. 1 at a frequency of 2.45 gigahertz (FIG. 3A) and 5.47 gigahertz (FIG. 3B). Generally, these analysis results show that the isolation between the antenna elements 104, 108, 112 was increased by about seven percent to about ten percent, and show the increased directivity of each antenna element in the direction of the sector that the particular antenna element serves.

FIG. 4 illustrate another exemplary embodiment of a multiple-antenna system 200 embodying one or more aspects of the present disclosure. In this particular example, the antenna 200 includes six antenna elements 204, six low frequency isolators/reflectors 216, six high frequency isolators/reflectors 228, and a ground plane 240. The components of the antenna 200 may be similar to the antenna 100 described above.

FIG. 5 illustrates analysis results measured for a prototype of the multiple-antenna system 200 shown in FIG. 4. These analysis results shown in FIG. 5 are provided only for purposes of illustration and not for purposes of limitation. More specifically, FIG. 5 illustrates exemplary azimuth plane radiation patterns measured for the six antenna elements 204 of a prototype of the multiple-antenna system 200 shown in FIG. 4 at a frequency of 5.35 gigahertz.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A system comprising:

a ground plane including a circular portion having a circumference and a center;

a plurality of antenna elements mounted to the ground plane along the circumference of the circular portion of the ground plane, the antenna elements equidistant from the center of the circular portion of the ground plane, the antenna elements spaced equally apart from each other such that a one hundred twenty degree(120°) arc is defined between mounting points of two adjacent antenna elements and the center of the circular portion of the ground plane;

a first plurality of isolators/reflectors in a spoked configuration centered at the center of the circular portion of the ground plane, such that the isolators/reflectors are positioned about the center of the circular portion of the ground plane and extend outwardly in a direction away from the center of the circular portion of the ground plane; and/or a second plurality of isolators/reflectors, each placed between a corresponding one of the antenna elements and the center of the circular portion of the ground plane;

wherein each of the first and the second pluralities of isolators/reflectors includes two vertical sections and a horizontal section that is generally parallel with the ground plane, and defining an inverted U-shaped configuration for each of the isolators/reflectors.

2. The system of claim 1, wherein each antenna element is configured for multi-band operation such that each antenna element is operable within a first frequency range and a second frequency range.

3. The system of claim 2, wherein:

the first frequency range is from about 2.4 gigahertz to about 2.5 gigahertz, and the second frequency range is from 4.9 gigahertz to 5.875 gigahertz; and/or the first frequency range is the 2.45 gigahertz band, and the second frequency range is the 5 gigahertz band.

4. The system of claim 1, wherein the first plurality of isolators/reflectors and the second plurality of isolators/reflectors are positioned relative to the antenna elements for increasing isolation between the antenna elements and/or for increasing directivity of each said antenna element in the direction of a sector that said antenna element serves.

5. The system of claim 1, wherein the system includes:

the plurality of antenna elements includes three antenna elements and the first and second pluralities of isolators/reflectors includes a total of six isolators/reflectors; or the plurality of antenna elements includes six antenna elements and the first and second pluralities of isolators/reflectors includes a total of twelve isolators/reflectors.

6. The system of claim 1, further comprising two or more coaxial cables coupled to the plurality of antenna elements, respectively, for feeding the antenna elements.

7. The system of claim 1, wherein each antenna element comprises first and second radiating arms and a feeding element, the first and second radiating arms and feeding element comprising electrically-conductive traces on the same side of a circuit board.

8. The system of claim 1, wherein the antenna elements comprise one or more of a monopole antenna, an inverted F antenna (IFA), and/or a planar inverted F antenna (PIFA).

9. The system of claim 1, wherein the first and second pluralities of isolators/reflectors are configured to be operable as both isolators and reflectors.

10. The system of claim 1, wherein the system includes twice as many isolators/reflectors as antenna elements.

11. The system of claim 1, wherein the ratio of antenna elements to isolators/reflectors is one-to-two.

12. The system of claim 1, wherein the system is a multiple input multiple output (MIMO) antenna system.

13. The system of claim 1, wherein the circular portion of the ground plane is an imaginary or reference circle on a surface of the ground plane.

14. A multiple input multiple output (MIMO) antenna system comprising the system of claim 1, wherein the first and second pluralities of isolators/reflectors are positioned relative to the antenna elements for increasing isolation between the antenna elements and for increasing directivity of each said antenna element in the direction of a sector that said antenna element serves.

* * * * *